US009734726B2

(12) United States Patent
Enns et al.

(10) Patent No.: US 9,734,726 B2
(45) Date of Patent: Aug. 15, 2017

(54) SYSTEMS AND METHODS FOR PROVIDING LANDING EXCEEDANCE WARNINGS AND AVOIDANCE

(71) Applicant: The Boeing Company, Chicago, IL (US)

(72) Inventors: Russell Enns, Chandler, AZ (US); Bryan Kashawlic, Chester Heights, PA (US)

(73) Assignee: The Boeing Company, Chicago, IL (US)

( * ) Notice: Subject to any disclaimer, the term of this patent is extended or adjusted under 35 U.S.C. 154(b) by 188 days.

(21) Appl. No.: 14/181,906

(22) Filed: Feb. 17, 2014

(65) Prior Publication Data

US 2015/0235560 A1 Aug. 20, 2015

(51) Int. Cl.
*G08G 5/02* (2006.01)

(52) U.S. Cl.
CPC ..... *G08G 5/02* (2013.01)

(58) Field of Classification Search
USPC ..... 701/17
See application file for complete search history.

(56) References Cited

U.S. PATENT DOCUMENTS 4,115,755 A 9/1978 Cotton
4,164,340 A * 8/1979 Simpson ..... G01S 1/18 244/186
4,330,827 A * 5/1982 Kettler ..... G05D 1/0676 244/186
4,378,518 A * 3/1983 Nixon ..... G05D 1/0816 244/180
4,413,320 A * 11/1983 Brandau ..... G05D 1/0676 244/183

(Continued)

FOREIGN PATENT DOCUMENTS

EP 2605037 6/2013
EP 2635942 A1 * 9/2013
WO WO 2007067192 A2 * 6/2016

OTHER PUBLICATIONS

Extended European Search Report for EP App. No. 15154878.1-1810.

*Primary Examiner* — Jean-Paul Cass
(74) *Attorney, Agent, or Firm* — Joseph M. Butscher; The Small Patent Law Group, LLC

(57) ABSTRACT

Systems and methods provide sloped landing exceedance warning and avoidance. One system includes a surface slope determination system configured to measure a plurality of distances between an aircraft and a surface. The system also includes an inertial navigation system configured to sense aircraft attitude information. A flight control system is communicatively coupled to the surface slope determination system and the inertial navigation system. The flight control system is configured to estimate a slope angle of the surface. The flight control system is also configured to determine one or more approach characteristics based on the slope angle and the aircraft attitude information. The flight control system is additionally configured to identify a warning condition and perform one or more avoidance measures when one or more of the approach characteristics exceeds a predetermined threshold. A pilot cuing device also generates a notification when the warning condition is identified.

20 Claims, 6 Drawing Sheets

(56) References Cited

U.S. PATENT DOCUMENTS 5,522,567 A * 6/1996 Kinstler ..... F41G 7/343 244/3.15
5,608,392 A * 3/1997 Faivre ..... G05D 1/0676 244/186
5,739,770 A * 4/1998 Liden ..... G05D 1/0676 340/976
6,012,001 A 1/2000 Scully
6,317,663 B1 * 11/2001 Meunier ..... B64D 45/04 340/945
6,450,456 B1 * 9/2002 Greene ..... G05D 1/0833 244/182
6,674,397 B2 * 1/2004 Hager ..... G01S 7/292 342/118
7,126,496 B2 10/2006 Greene
7,693,620 B2 * 4/2010 Dubeck ..... G01C 23/00 701/16
8,025,256 B2 9/2011 Miller
8,374,736 B1 2/2013 Rupnik
2003/0048203 A1 * 3/2003 Clary ..... G01C 23/00 340/945
2003/0227412 A1 * 12/2003 Stewart ..... G01S 1/14 343/705
2009/0319105 A1 * 12/2009 Conner ..... G08G 5/02 701/16
2011/0021225 A1 * 1/2011 Cosimini ..... H04B 7/0671 455/507
2011/0106345 A1 * 5/2011 Takacs ..... G05D 1/0676 701/17
2011/0285981 A1 * 11/2011 Justice ..... G01S 7/4813 356/4.01
2012/0265376 A1 * 10/2012 Fleiger-Holmes ..... G01S 1/18 701/16
2013/0103233 A1 4/2013 Bourret
2013/0191016 A1 * 7/2013 Baillon ..... B64D 45/04 701/301
2014/0249704 A1 * 9/2014 De Tarso Ferreira ..... G05D 1/0676 701/18
2014/0365041 A1 * 12/2014 Deker ..... G05D 1/0607 701/4
2015/0235560 A1 * 8/2015 Enns ..... G08G 5/02 701/17

* cited by examiner

SYSTEMS AND METHODS FOR PROVIDING LANDING EXCEEDANCE WARNINGS AND AVOIDANCE

BACKGROUND

The present disclosure relates generally to warning systems for aiding a pilot when approaching a surface for landing.

Landing aircraft on unimproved, sloped, or moving terrain requires experienced piloting skill. For example, fixed wing aircraft often land on grass runways that may be sloped. Similarly, rotary wing aircraft often attempt to land on landing surfaces that may be sloped and/or moving. For example, helicopters often land on sea-bearing vessels, such as ships and aircraft carriers. The slope of the landing surface may exceed allowable vehicular limits, thereby preventing landing. For example, an excessively sloped or uneven landing surface may cause the aircraft to become unbalanced after landing, which may result in the aircraft overturning. Additionally, the slope of the landing surface may be difficult to discern from the vantage point or viewing position of the cockpit. For example, environmental conditions, such as weather, may impair visibility of the landing surface such that a pilot is not able to properly view the slope of the landing surface to determine whether the surface is suitable for landing.

Conventional systems are known for providing warnings to pilots with respect to different flight conditions. However, these known systems may not perform satisfactorily to aid a pilot when landing aircraft on unimproved, sloped, or moving surface or terrain. Additionally, these known systems do not provide advance warning or avoidance assistance of exceedingly sloped terrain before a pilot attempts to land on the terrain. These known systems also do not provide an indication to the pilot to avoid landing on the sloped terrain.

BRIEF DESCRIPTION

In accordance with an embodiment, a system for aiding a pilot during landing is provided. The system includes a surface slope determination system configured to measure a plurality of distances between an aircraft and a surface. The system also includes an inertial navigation system configured to sense aircraft attitude information. The system further includes a flight control system communicatively coupled to the surface slope determination system and the inertial navigation system. The flight control system is configured to estimate a slope angle of the surface based on the distances. The flight control system is further configured to determine one or more approach characteristics based on the slope angle and the aircraft attitude information. The flight control system is also configured to identify a warning condition and perform one or more avoidance measures when one or more of the approach characteristics exceed a predetermined threshold. The system also includes a pilot cuing device communicatively coupled to the flight control system. The pilot cuing device is configured to generate a notification when the warning condition is identified.

In accordance with another embodiment, a method of aiding a pilot when approaching a surface is provided. The method includes measuring a plurality of distances between an aircraft and a surface. The method also includes sensing aircraft attitude information and estimating a slope angle associated with the surface based on the distance. The method further includes determining one or more approach characteristics based on the slope angle and the aircraft attitude information. The method additionally includes identifying a warning condition when one or more of the approach characteristics exceed a predetermined threshold and generating a warning notification upon identification of the warning condition. The method also includes performing one or more avoidance measures in response to the warning condition.

In accordance with another embodiment, an aerial platform is provided that includes one of a fixed wing or rotary wing aircraft, with the fixed wing or rotary wing aircraft having a warning system. The warning system includes a surface slope determination system configured to measure a plurality of distances between an aircraft and a surface. The warning system also includes an inertial navigation system configured to sense aircraft attitude information for the aircraft and a flight control system communicatively coupled to the surface slope determination system and the inertial navigation system. The flight control system is configured to estimate a slope angle of the surface based on the distances and determine one or more approach characteristics based on the slope angle and the aircraft attitude information. The flight control system is additionally configured to identify a warning condition and perform one or more avoidance measures when one or more of the approach characteristics exceed a predetermined threshold. The warning system further includes a pilot cuing device communicatively coupled to the flight control system, wherein the pilot cuing device is configured to generate a notification when the warning condition is identified.

The features and functions that have been discussed can be achieved independently in various embodiments or may be combined in yet other embodiments, further details of which can be seen with reference to the following description and drawings.

BRIEF DESCRIPTION OF THE DRAWINGS

The disclosure can be better understood with reference to the following drawings and description. The components in the figures are not necessarily to scale, emphasis, instead, being placed upon illustrating the principles of the disclosure. In the drawings, like numerals represent like parts.

DETAILED DESCRIPTION

Figure 1:
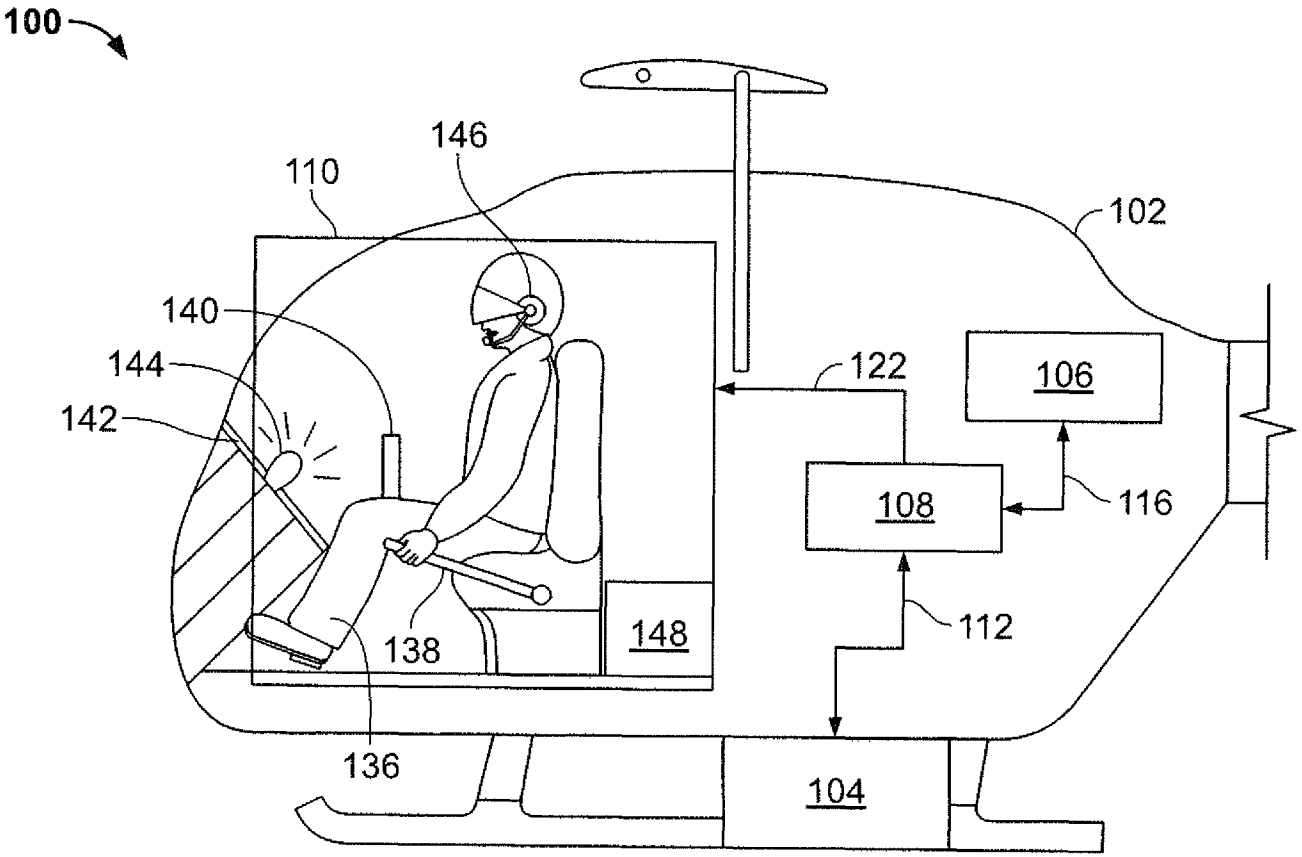
FIG. 1 is a schematic view of an aircraft having a warning system in accordance with an embodiment.

The following detailed description of certain embodiments will be better understood when read in conjunction with the appended drawings. It should be understood that the various embodiments are not limited to the arrangements and instrumentality shown in the drawings. To the extent that the figures illustrate diagrams of the functional blocks of various embodiments, the functional blocks are not necessarily indicative of the division between hardware circuitry. Thus, for example, one or more of the functional blocks (e.g., processors, controllers, or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "system," "unit," or "module" may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. The modules, systems, or units shown in the attached figures may represent the hardware that operates based on software or hard-wired instructions, the software that directs hardware to perform the operations, or a combination thereof.

Described herein are methods and systems for aiding an aircraft pilot when the aircraft is approaching a surface for landing. For example, in various embodiments, a system is provided for aiding a pilot during landing with intuitive tactile cues (e.g., provide as part of a pilot cueing device communicatively coupled to a flight control system) for warning the pilot and avoiding landing on slopes whose angle exceeds that allowable for the aircraft. The system also can perform one or more avoidance measures. In various embodiments, the aircraft may be guided by a pilot onboard the aircraft, or may be unmanned such that the aircraft is piloted by a remote operator at a remote operation station. Thus, the cuing system may be onboard the aircraft or may be at the remote operation station. For example, the remote operation station may include a vertical axis controller and a translation controller (e.g., cyclic stick).

In operation, the warning system may provide different types of landing exceedance warnings and/or avoidance mechanisms, such as vibration alerts, back drives, and/or soft stops, among others, that may applied, for example, to one or more controllers onboard the aircraft of at the remote operation station (e.g., vertical axis controller and/or the translation controller (of the remote operation station). In various embodiments, the surface is a landing surface upon which the aircraft is attempting to land, such as, for example, a runway, helipad, ship-based moving surface, unimproved surface, and the like. The systems and methods of various embodiments aid the pilot by providing notification, such as one or more different types of cuing, or perform avoidance measures, before one or more approach characteristics exceed allowable limits.

The approach characteristics in various embodiments are based on the slope of the surface. The allowable limits may be based, for example, on the geometry, performance characteristics, and/or structural limits of the aircraft. It should be noted that while the notification to the pilot may be described as including at least one of an aural cue, a visual cue, or a tactile cue, other cues may be provided as desired or needed.

In general, one or more warning systems of various embodiments may include one or more flight control computers communicatively coupled to one or more sensors or detectors, such as configured as a surface slope determination system in one embodiment. The surface slope determination system may include a plurality of sensors onboard and/or off-board the aircraft that are configured to measure a distance between the aircraft and the surface. A flight control computer(s) may also include a flight control system configured to use the distance to determining one or more warning conditions. For example, in various embodiments, the flight control system may trigger a warning condition when an approach characteristic exceeds a threshold, such as a predetermined or predefined threshold. However, the threshold may be changed, such as based on a user input, flight conditions, or landing conditions, among others. In various embodiments, for example, the approach characteristic may be a limit on the allowable slope of the landing surface (e.g., when the landing surface is excessively sloped such that landing on the surface may be unsafe).

It should be noted that in various embodiments, the warning system operates in combination with the pilot cuing device to provide a warning to the pilot when the flight control system triggers the warning condition (which may also include performing avoidance measures). Thus, the system may assist a pilot with different cues (and avoidance measures) when landing on as sloped terrain.

By practicing various embodiments, improved safety of flight and/or reduced risk during landing may be provided. For example, by estimating the slope of the landing surface, the warning system may determine a portion of the surface that may be unfit for landing, as well as a portion of the surface that is more desirable for landing. Optionally or additionally, the warning system may provide a training aide to assist when determining whether the surface is an appropriate landing surface. As another example, the warning system may allow the pilot to land on a surface during inclement weather where visibility of the surface may be impaired.

A technical effect of various embodiments is improved landing of aircraft, such as on uneven terrain or on ship-based moving surfaces. A technical effect of various embodiments is a reduction of reliance on pilot judgment or pilot skill to avoid accidents while landing on different surfaces, such as sloped or moving surfaces. A technical effect of various embodiments is a reduction of rollover accidents of aircraft.

As used herein, when reference is made to a "surface," this generally refers to a portion of terrain or an object (e.g., a ship) on which an aircraft may approach for landing. Accordingly, the surface may include artificial or natural terrain. For example, the surface may be a runway, a helipad, a road, and/or the like. As another example, the surface may be an unimproved surface such as a grass field, gravel surface, and/or the like. The surface may be a fixed surface such that the surface does not move (e.g., change attitude or altitude). Alternatively, the surface may be a moving surface. For example, the surface may be a helipad onboard a sea-bearing vessel, such as, for example a ship or aircraft carrier. As such, the term surface is not limited to a particular type of kind of surface on which the aircraft is attempting to land.

Similarly, as used herein, the term "aircraft" generally refers to any air vehicle. In various embodiments, the aircraft may be a vertical lift aircraft capable of vertical or short field takeoff and landing (VSTOL). In some embodiments, the aircraft may be fixed wing aircraft or rotary wing aircraft. In various embodiments, the rotary wing aircraft may include rotorcraft such as, for example, a helicopter. Thus, the term aircraft is not limited to a particular fixed wing or rotary wing aircraft.

With reference now to FIG. 1, it should be noted that this figure is schematic in nature and intended merely for example. In various embodiments, various aspects (e.g., dimensions and relative positions) or systems may be omitted, modified, or added. Further, various modules, systems, or other aspects may be combined. Yet further still, various modules or systems may be separated into sub-modules or sub-systems and/or functionality of a given module or system may be shared between or assigned differently to different modules or systems.

FIG. 1 illustrates a warning system 100 in accordance with an embodiment. In the illustrated embodiment, the warning system 100 is provided as part of or in combination with an aerial platform, such as an aircraft 102, that includes a surface slope determination system 104, an inertial navigation system 106, a flight control system 108, and a pilot cuing device 110. For example, the warning system 100 may provide an environment within the aircraft 102 that aids a pilot 146 in operating the aircraft 102, particularly, landing the aircraft 102, which may interface or interact with one of more of the systems or components described in more detail herein.

In the illustrated embodiment, the aircraft 102 is embodied as a helicopter. However, the aircraft 102 may be any air vehicle as discussed above. The aircraft 102 also may include other systems and components to support the operation of the various components described herein (e.g., global positioning systems (GPS), communication systems, antennas, instruments, pilot-vehicle interfaces, joysticks, yokes, and/or the like). The aircraft 102 may also include wiring to communicatively couple various components to one another. For example, the surface slope determination system 104 may be communicatively coupled to the flight control system 108 via wiring 112. As used herein, wiring may include any electrical or optical communication means to communicatively couple one component to another. The wiring may be direct coupling of various components, or may be part of an electrical network. For example, in various embodiments, the wiring 112 may be a component of a multiplex bus system such as, for example, a Military Standard (MIL-STD) 1553 bus, an Aeronautical Radio Incorporated® (ARINC) 429 bus, a fiber channel network, and/or the like. In some embodiments, communicative coupling of some (or all) of the components may be provided wirelessly.

The inertial navigation system 106 is configured to sense attitude information associated with the aircraft 102. For example, in various embodiments, the attitude information may include Euler angles associated with the orientation of the aircraft 102. For example, the Euler angles may include a body axis pitch angle $\theta_h$ (shown in FIGS. 3 and 4), a body axis roll angle $\phi_h$ (not shown), and a body axis yaw angle $\psi_h$ (not shown). The Euler angles may define the attitude of the aircraft 102 with respect to an ideal level surface 120 (shown in FIG. 2), as is commonly known in the art. The inertial navigation system 106 may also be configured to sense geographic location information, such as, latitude, longitude, and altitude associated with the aircraft 102. For example, in various embodiments, the inertial navigation system 106 may be configured with a global positioning system to sense the geographic location information. The inertial navigation system 106 may be communicatively coupled to the flight control system 108 via wiring 116 such that the inertial navigation system 106 may provide the attitude information to the flight control system 108 and/or other components. As discussed above, the wiring 116 may be embodied as an electrical network.

Figure 2:
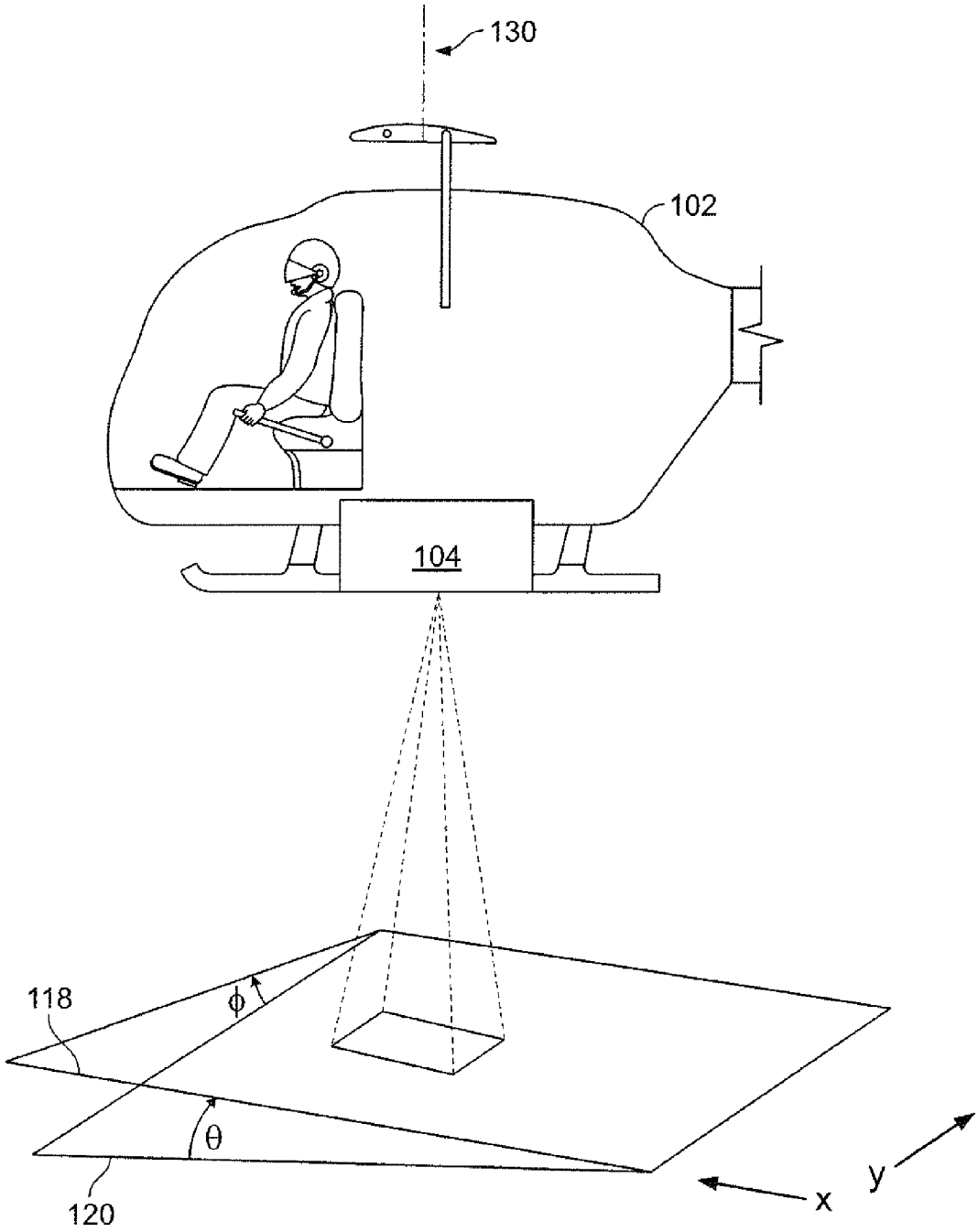
FIG. 2 is an illustration of the aircraft of FIG. 1 preparing for landing on a surface in accordance with an embodiment.

With reference to FIG. 2, and continued reference to FIG. 1, this Figure illustrates an aircraft 102 preparing for landing on a surface 118 in accordance with an embodiment. The surface 118 may be any landing surface as discussed above. The surface 118 may be sloped in one or more directions relative to a level surface 120. The level surface 120 may represent an imaginary plane having no slope (e.g., a level plane such that the acceleration of gravity is perpendicular to the face of the level surface 120). The surface 118 may be sloped based on an angle $\theta$ formed by the intersection of the surface 118 and the level surface 120 in a longitudinal direction X. Similarly, the surface 118 may be sloped based on an angle $\phi$ formed by the intersection of the surface 118 and the level surface 120 in a lateral direction Y as discussed above. The slope of the surface 118 caused by the angles $\theta$ and $\phi$ may affect the attitude of the aircraft 102 when the aircraft 102 lands on the surface 118 (e.g., the weight of the aircraft 102 on the aircraft's wheels or landing portions, such as skids).

In some embodiments, as described herein, landing the aircraft 102 on the surface 118 may cause the aircraft 102 to become unstable and/or may result in damage to the aircraft 102. For example, the surface 118 may have a large slope (e.g., an angle $\theta$ having a value between approximately 7° to 12° or more) such that when the aircraft 102 is resting on the surface 118, a portion of the surface may interfere with or collide with a portion of the aircraft 102. Alternatively, the aircraft 102 may be configured such that the center of gravity (C.G.) of the aircraft 102 may cause the aircraft 102 to become unbalanced or unstable (e.g., roll or capsize) if the aircraft 102 is landed on the surface 118.

Various embodiments of the warning system 100 (shown in FIG. 1) provide a notification when the surface 118 may be unsuitable for landing, which includes one or more different cues in various embodiments. The flight control system 108 (shown in FIG. 1) is communicatively coupled to the surface slope determination system 104 and the inertial navigation system 106 (shown in FIG. 1). The flight control system 108 may be configured to estimate the slope of the surface 118 based on distance information received from the surface slope determination system 104.

The surface slope determination system 104 is configured to determine or measure a plurality of distances between the aircraft 102 and the surface 118. The measurement may include determining or estimating an altitude above ground level and/or a height above terrain. The distances may be the distances H (shown in FIGS. 3 and 4) as is discussed below. The surface slope determination system 104 may include one or more sensors to sense the distances. Additionally, the sensors may be of different types. For example, the surface slope determination system 104 may measure the distances based on information received from at least one of an ultrasonic sensor, a RADAR sensor, or a laser sensor, among other sensors. Additionally or optionally, the surface slope determination system 104 may use an elevation database to measure the distances. For example, the surface slope determination system 104 may be communicatively coupled to the inertial navigation system 106 (FIG. 1). The inertial navigation system 106 may provide position information (e.g., latitude, longitude, and altitude) to the surface slope determination system 104. The surface slope determination system 104 may then use the position information to estimate the distances based on, for example, prerecorded, or predetermined elevation information stored in the elevation database. In various embodiments, other sensor types may be used in conjunction with, or in place of the sensors described herein. In various embodiments, more than one sensor may be used such that a plurality of distance measurements may be taken.

The sensors various embodiments may be, for example, gimbaled sensors or fixed sensors. As used herein, fixed sensors generally include sensors that are aligned with a vertical axis 130 of the aircraft 102. As used herein, gimbaled sensors generally include sensors that are capable of moving or rotating independent of any movement of the aircraft 102 such that the sensors are aligned with gravity (e.g., aligned to point toward the Earth, regardless of aircraft 102 orientation).

Figure 3:
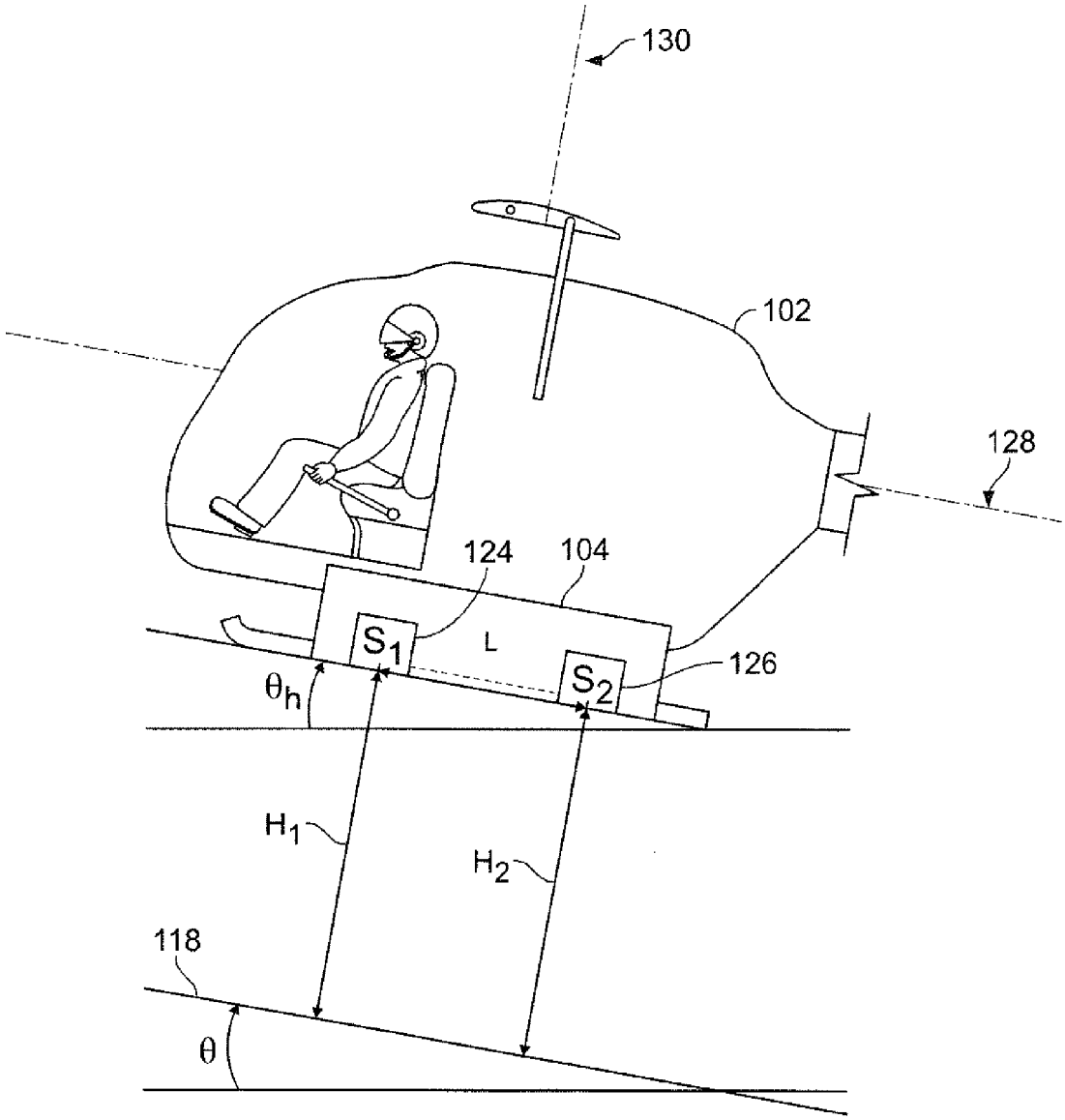
FIG. 3 is an illustration of the aircraft of FIG. 1 showing operation of fixed sensors in accordance with an embodiment.

FIG. 3 is an illustration of the aircraft 102 configured with fixed sensors 124 and 126 in accordance with an embodiment. The fixed sensors 124 and 126 may be any of types of sensors as discussed above, and may be of the same or different types. The fixed sensors 124 and 126 may be fixed to the airframe of the aircraft 102 such that the fixed sensors 124 and 126 are not gimbaled. The fixed sensors 124 and 126 rotate with the body of the aircraft 102, such that the fixed sensors 124 and 126 are biased (e.g., rotated) by the body axis pitch angle $\theta_h$ of the aircraft 102. Similarly, the fixed sensors 124 and 126 may be biased by the body axis roll angle $\phi_h$ (not shown), and a body axis yaw angle $\psi_h$. Accordingly, the fixed sensors 124 and 126 sense distances H1 and H2, respectively, that extend along the direction of the vertical axis 130 of the aircraft 102. The distances H1 and H2 may be defined between the aircraft 102 and the surface 118. The fixed sensors 124 and 126 may be separated by a distance L extending along a longitudinal axis 128 (e.g., an axis perpendicular to the vertical axis 130 of the aircraft 104), which may be varied as desired or needed.

The flight control system 108 (shown in FIG. 1) in various embodiments is configured to estimate the slope angle θ of the surface 118 based on the distances H1 and H2 sensed by the fixed sensors 124 and 126, and the attitude information sensed by the inertial navigation system 106. For example, in various embodiments the flight control system 108 may estimate the slope angle θ using the following:

$$\theta = \theta_h - \tan^{-1}\left(\frac{(H2 - H1)}{L}\right) \qquad \text{Eq. 1}$$

In equation 1, the body axis pitch angle $\theta_h$ may be sensed by the inertial navigation system 106 (shown in FIG. 1). As is discussed below, the flight control system 108 may use the slope angle θ to identify a warning condition.

In various embodiments, the surface slope determination system 104 may be further configured with a third fixed sensor extending along a lateral axis (not shown) of the aircraft 102. The lateral axis may be perpendicular to the longitudinal axis 128 and the vertical axis 130. The flight control system 108 may estimate the slope angle ϕ (shown in FIG. 2) in the lateral direction based on the distance information sensed by the third fixed sensor and the fixed sensors 124 and 126.

Figure 4:
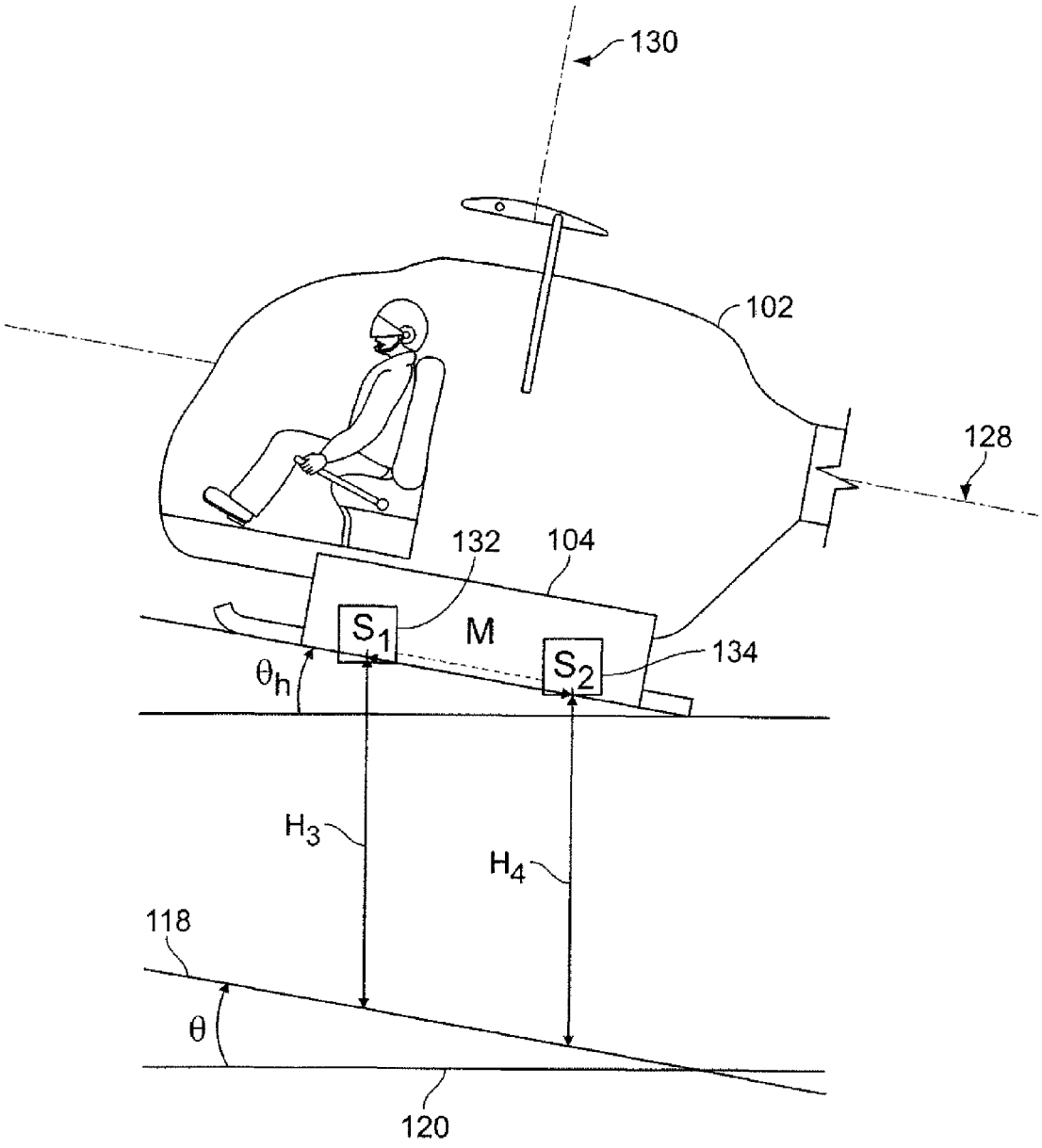
FIG. 4 is an illustration of the aircraft of FIG. 1 showing operation of gimbaled sensors in accordance with an embodiment.

FIG. 4 is an illustration of the aircraft 102 configured with gimbaled sensors 132 and 134 in accordance with an embodiment. The gimbaled sensors 132 and 134 may be any of the types of sensors as discussed above, and may be of the same or different types. The gimbaled sensors 132 and 134 may be unconstrained (e.g., free to pivot or rotate) by the body of the aircraft 102 such that the gimbaled sensors 132 and 134 are not biased or effected by rotation of the aircraft 102. For example, changes in the body axis pitch angle $\theta_h$ does not influence the orientation of the gimbaled sensors 132 and 134 in various embodiments. Similarly, changes in the body axis roll angle $\phi_h$ (not shown), and the body axis yaw angle $\psi_h$ do not influence the orientation of the gimbaled sensors 132 and 134. Thus, the gimbaled sensors 132 and 134 substantially point toward the "ground." The fixed sensors 132 and 134 sense distances H3 and H4, respectively, that extend along the direction of gravity. In other words, the distances H3 and H4 may be perpendicular to the level surface 120. The distances H3 and H4 may be defined between the aircraft 102 and the surface 118. The gimbaled sensors 132 and 134 may be separated by a distance M extending parallel the longitudinal axis 128, which may be varied as desired or needed. In various embodiments, the distance M may be substantially similar to the distance L shown in FIG. 3.

Similar to the discussion above in relation to equation 1, the flight control system 108 (shown in FIG. 1) may estimate the slope angle θ of the surface 118 based on distances H3 and H4 sensed by the gimbaled sensors 132 and 134, and the attitude information sensed by the inertial navigation system 106. For example, the flight control system 108 may estimate the slope angle θ using the following:

$$\theta = \tan^{-1}\left(\frac{(H2 - H1)}{L\cos\theta_h}\right) \qquad \text{(eq. 2)}$$

As discussed above, the body axis pitch angle $\theta_h$ may be sensed by the inertial navigation system 106 (shown in FIG. 1). The flight control system 108 may use the slope angle θ to identify a warning condition.

In various embodiments, the surface slope determination system 104 may be further configured with a third gimbaled sensor (not shown) extending along a lateral axis (not shown) of the aircraft 102. The lateral axis may be perpendicular to the longitudinal axis 128 and the vertical axis 130. The flight control system 108 may estimate the slope angle ϕ (shown in FIG. 2) in the lateral direction based on the distance information sensed by the third gimbaled sensor and the gimbaled sensors 132 and 134. Additionally or optionally, the surface slope determination system 104 may include one or more gimbaled sensors and fixed sensors.

Returning to the discussion of FIG. 1, the flight control system 108 may determine one or more approach characteristics based on the slope angles θ and ϕ (shown in FIG. 2), and/or the aircraft 102 attitude information sensed by the inertial navigation system 106. The approach characteristics in various embodiments may include at least one of a relative attitude difference between the aircraft 102, and at least one of the slope angles θ or ϕ (shown in FIG. 2), or a rate of change in the slope angles θ or ϕ. The flight control system 108 may also estimate a relative attitude difference between the aircraft and at least one of the slope angles θ or $\phi$. For example, the flight control system 108 may determine the difference between the slope angle $\theta$ and the body axis pitch angle $\theta_h$ (shown in FIGS. 3 and 4).

In various embodiments, the surface 118 (shown in FIGS. 2, 3, and 4) may be a moving surface. For example, the surface 118 may be embodied as a helipad onboard a sea-bearing vessel, such as an aircraft carrier. As a moving surface, the slope angles $\theta$ and $\phi$ may change as the ship, and hence the helipad, traverses swells and waves at sea. The flight control system 108 may estimate the rate of change of the slope angles $\theta$ and $\phi$. For example, the flight control system 108 may monitor the slope angles $\theta$ and $\phi$ changing over time.

The flight control system 108 is various embodiments may identify a warning condition when one or more of the approach characteristics exceed a predetermined (or defined) threshold. The warning condition may provide an advance notification such that when landing on the surface 118, the aircraft 102 may become unstable, and/or may result in improper balance of the aircraft 102. The predetermined threshold may be based on at least one of a relative attitude difference between the aircraft 102 and at least one of the surface slope $\theta$ or $\phi$, a rate of change of the surface slope $\theta$ or $\phi$, aircraft ground speed, a center of gravity, or an aircraft structural limit, among other factors.

In one embodiment, the predetermined threshold may be based on a relative attitude difference. For example, the relative attitude difference may represent the difference between the aircraft 102 body axis pitch angle $\theta_h$ and the surface slope angle $\theta$. As another example, the relative attitude difference may represent the difference between the aircraft 102 body axis roll angle $\phi_h$ and the ground slope angle $\phi$. The warning condition may be identified when the relative attitude difference exceeds a predetermined threshold. For example, the predetermined threshold for the relative attitude difference between the body axis pitch angle $\theta_h$ and the surface slope angle $\theta$ may be approximately 7° to 12° or more. However, other angles may be used, such as based on the type of aircraft or landing requirements.

In one embodiment, the predetermined threshold may be based on the center of gravity of the aircraft 102. As such, the center of gravity of the aircraft 102 may limit the relative attitude difference such that proper balance may be maintained upon landing. For example, when the aircraft 102 is configured with a forward loaded center of gravity, the allowable surface slope angle $\theta$ may be limited to 5° (which defines the predetermined threshold value). As another example, when the aircraft 102 is configured with an aft loaded center of gravity, the allowable surface slope angle $\theta$ may be limited to 10°.

In one embodiment, the predetermined threshold may be based on structural limitations. The structural limitations may be based on allowable forces acceptable for the aircraft 102. The structural limitations may be based on performance characteristics such as, for example, airspeed, rate of descent, acceleration, and/or the like. For example, the aircraft 102 may be configured with a landing gear having an allowable loading, which may be based on the rate of descent. As another example, the landing gear may be rated for an allowable airspeed. Additionally, the structural limitation may be based on an allowable normal loading of the aircraft (e.g., acceptable "g" loading). As another example, the structural limitation may be based on the weight of the aircraft and/or cargo carried by the aircraft. One or more of these limitations may be used to define the predetermined threshold.

In various embodiments, the pilot cuing device 110 may be communicatively coupled to the flight control system 108 via the wiring 122. The pilot cuing device 110 may be configured to generate a notification when the warning condition is identified. The notification may be used to alert a pilot 136 as to whether the attitude of the aircraft 102 is within acceptable limits, approaching unacceptable limits, or exceeding unacceptable limits. The notification may include, for example, at least one of a tactile cue, a visual cue, or an aural cue, which may be varied based on the type of warning and the level of the warning (e.g., how close the characteristic is to the threshold). In some embodiments, different cues may be used for different warnings or characteristics, and/or for different levels of the warnings.

The tactile cue may be at least one of a soft stop or a vibration alert. For example, in an embodiment, the aircraft 102 may be a rotary wing aircraft (e.g., a helicopter) having a vertical axis controller 138 (e.g., a collective stick) and a translation controller 140 (e.g., a cyclic stick) as shown in FIG. 1.

The vertical axis controller 138 and/or the translation controller 140 may include one or more soft stops. A soft stop, as used herein, may be an artificial stop or region of increased resistance preventing, limiting, or otherwise discouraging (or resisting) further movement of the vertical axis controller 138 and/or the translation controller 140 in one or more directions. For example, a soft stop may limit movement of the vertical axis controller 138 when the warning condition is identified. It should be noted that the soft stop in various embodiments may be overcome with the application of sufficient force (e.g., the pilot 136 can push through the tactile cue to maintain a rate of descent if desired).

Additionally or optionally, the vertical axis controller 138 and/or the translation controller 140 may be automatically back driven such that the vertical axis controller 138 and/or the translation controller 140 automatically move to avoid exceeding the slope or relative attitude limit. The automatic movement allows the aircraft 102 to avoid landing on unsuitable terrain. For example, the vertical axis controller 138 may be back driven to reduce or otherwise prevent the aircraft 102 from approaching or achieving a rate of descent that would allow the aircraft 102 to land. The amount of force to create the movement of the controllers 138, 140 may be limited such that the pilot 136 may override the back drive command. It should be noted that cueing of the translation controller 140, such as a cyclic stick, may limit relative attitudes. For example, one or more longitudinal/lateral cues may be used to limit relative attitudes between the vehicle (e.g., aircraft) and the local ground plane. It should be noted that other avoidance measures may be performed as desired or needed.

Additionally or optionally, the vertical axis controller 138 and/or the translation controller 140 may include a vibration alert. The vibration alert may be provided as a shaking of the vertical axis controller 138 and/or the translation controller 140. For example, a stick shaker, as is known in the art, may be used to cause the vertical axis controller 138 and/or the translation controller 140 to vibrate. Additionally, the severity of the vibration may be varied based on the warning condition, such as the type or level of the warning condition. For example, the vertical axis controller 138 may vibrate less aggressively when the slope angles $\theta$ and/or $\phi$ exceed approach the predetermined threshold and may vibrate more aggressively when the slope angles $\theta$ and/or $\phi$ exceed the predetermined threshold.

Additionally or optionally, the notification generated by the pilot cuing device 110 may include a visual cue. For example, the pilot cuing device 110 may include an instrument panel 142 having a light 144 that becomes illuminated to provide a notification to the pilot 136 when the warning condition is identified. However, other types of visual cues may be provided, such as text or graphical warning indicators.

Additionally or optionally, the notification generated by the pilot cuing device 110 may include an aural cue. For example, the pilot cuing device 110 may include a helmet mounted aural cuing system 146 configured to output one or more tones, such as, for example a ground proximity warning tone as is known in the art, when the warning condition is identified.

In various embodiments, the pilot cuing device 110 may include a cue prioritization system 148. It should be noted the cue prioritization system 148 may be embodied in other systems in addition to, or in alternative to the pilot cuing device 110. For example, in various embodiments, the cue prioritization system 148 may be a component of the flight control system 108. The cue prioritization system 148 may be communicatively coupled to the pilot cuing device 110 and at least one of the vertical axis controller 138, the translation controller 140, the light 144, or the aural cuing system 146. The cue prioritization system 148 may be configured to selectively determine the manner and/or order in which the notifications will be presented to the pilot 138. The cue prioritization system 148 may resolve any ambiguity in the cause of the notification. For example, the cue prioritization system 148 may provide a vibration alert in the vertical axis controller 138 in addition to an aural warning in the aural cuing system 146 to draw attention to the vertical axis controller 138.

In various embodiments, the flight control system 108 may be further configured to take one or more avoidance measures in response to the warning condition. The avoidance measures may include at least one of an attitude hold or an altitude hold. In various embodiments, when an attitude hold is initiated, this hold causes the aircraft 102 to maintain or substantially remain in a fixed attitude (e.g., the Euler angles are maintained nearly constant). In various embodiments, when an altitude hold is initiated, this hold is a state in which the aircraft 102 maintains or remains (e.g., hovers) at a predetermined altitude (e.g., 10 feet).

The avoidance measure may also include applying a tactile cue. As discussed above, a tactile cue may include at least one of a soft stop, vibration alert, or a back drive applied to vertical axis controller 138 and/or the translation controller 140. The application of the tactile cue and/or one or more avoidance measures allows the aircraft 102 to avoid landing on the surface 118 having a slope that exceeds limits of the aircraft 102.

Figure 5:
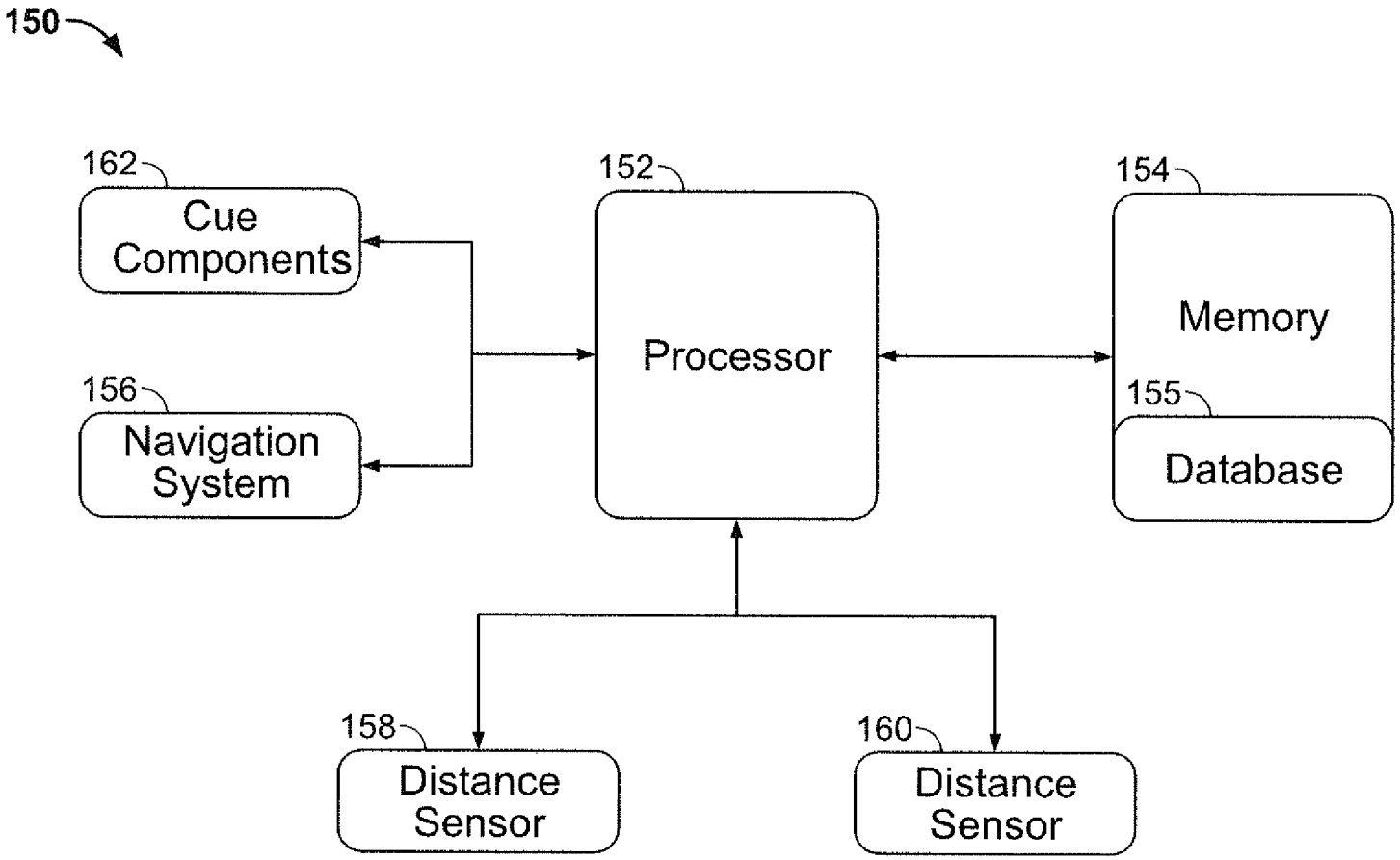
FIG. 5 is a system block diagram showing components of a warning system in accordance with an embodiment.

With reference now to FIG. 5, and continued reference to FIG. 1, a system diagram is illustrated showing components of a warning system 150 in accordance with an embodiment. The warning system 150, and various components in the illustrated embodiment, may be embodied, for example, as the warning system 100 described above in connection with FIG. 1. However, the warning system 150 also may be implemented as a separate or different system.

The warning system 150 generally includes a processor 152. The processor 152 may be one component of the flight control system 108 (shown in FIG. 1). The processor 152 may comprise a plurality of processing devices or co-processors. Additionally or optionally, the processor 152 may include a microprocessor-based system including systems using microcontrollers, reduced instruction set computers (RISC), application specific integrated circuits (ASICs), logic circuits, graphics processing units (GPUs), fixed programmable grid arrays (FPGAs), and/or any other circuit or processor capable of executing the functions described herein.

The processor 152 is communicatively coupled to a memory 154. The memory 154 may be configured to store information for a short term (e.g., sensor data during processing) or for a longer term (e.g., data relating to predetermined thresholds or predetermined values, such as, the predetermined altitude hold altitude, pitch and bank angle limits, and/or the like). The memory 154 may be any type of data storage device, which may also store one or more databases 155 of information. For example, the memory 154 may store an elevation database having altitude information for various geographic locations. However, any type of information may be stored in the databases 155, such as the predetermined threshold values and/or other aircraft specific performance or operating characteristics, among other information, which may be used as described in more detail herein. It should be noted that the memory 154 may be separate from, or form part of the processor 152.

In operation, the processor 152 may receive, for example, attitude information from an navigation system 156 (which may be embodied as the inertial navigation system 106 shown in FIG. 1) and/or may receive height information from one or more distance sensors 158 and 160 (two distance sensors are shown for illustration). The one or more distance sensors 158 and 160 may form part of, for example, the surface slope determination system 104 (shown in FIG. 1). The processor 152 may then calculate slope angles associated with the landing surface 118 (shown in FIGS. 2 and 3) based on the height information and the attitude information. The processor 152 may then determine a warning condition based on the slope angles as described in more detail herein and then generate one or more notifications when the slope angles exceed predetermined thresholds.

The processor 152 sends a notification to one or more cue components 162 (which may be embodied as or form part of the pilot cuing device 110 shown in FIG. 1). The cue components 162 may include various sub-components to alert a pilot that one or more notifications have been triggered. As described above in connection with FIG. 1, the cue components may provide visual and/or aural cues.

Figure 6:
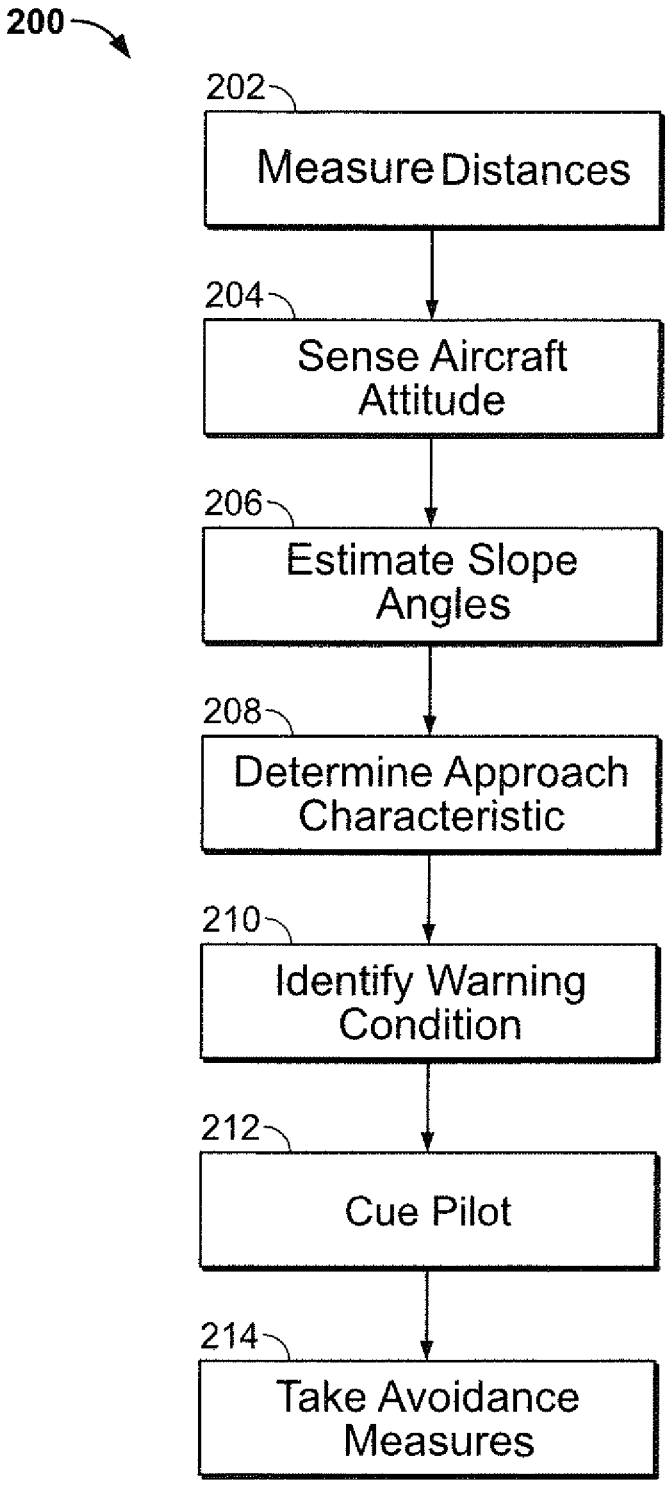
FIG. 6 is an illustration of operations for aiding a pilot when approaching a surface in accordance with an embodiment.

FIG. 6 is a flowchart of an embodiment of a method 200 for aiding a pilot when approaching a surface, such as to provide warning as cues within the aircraft. In various embodiments, the method 200, for example, may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. In various embodiments, portions, aspects, and/or variations of the method 400 may be able to be used as one or more algorithms to direct hardware to perform operations described herein.

In particular, at 202, a plurality of distances between an aircraft and a surface may be measured. The measurement may include determining or estimating the altitude of the aircraft above ground level. The distances may include plural distances measured by a plurality of sensors. The distances may be measured based on information received from at least one of an ultrasonic sensor, a RADAR sensor, a laser sensor, or a terrain elevation database as described herein. In various embodiments, at least one of the ultrasonic sensor, the RADAR sensor, or the laser sensor may be gimbaled (while in other embodiments one or more are fixed). Alternatively, at least one of the ultrasonic sensor, the RADAR sensor, or the laser sensor may be fixed relative to the aircraft.

The method 200 also includes at 204, sensing aircraft attitude information. In various embodiments, the aircraft may include an inertial navigation system configured to sense the attitude information as described herein. The attitude information may include a body axis pitch angle $\theta$, a body axis roll angle $\phi$, and/or a heading angle $\psi$ (e.g., Euler angles).

The method 200 also includes at 206, estimating or determining one or more slope angles associated with the surface based on the distance measured at 202. The estimation may include estimating at least one of a lateral slope angle formed between an intersection of the surface and a level ground plane in a lateral direction, or a longitudinal slope angle formed between an intersection of the surface and the level ground plane in the longitudinal direction. In various embodiments, the surface may include a moving surface and estimation of the surface slope angle may include estimation of a rate of change of the surface slope angle.

The method 200 also includes at 208, determining or identifying an approach characteristic. The approach characteristic may be based on the slope angle determined at 206 and the aircraft attitude information sensed at 204. In various embodiments, the approach characteristic may include at least one of a relative attitude difference between the aircraft and the surface slope angle, or a rate of change of the surface slope angle, among others.

The method 200 also includes at 210, identifying a warning condition. The warning condition may be identified when one or more of the approach characteristics exceeds a predetermined threshold. The predetermined threshold may be based on at least one of a rate of descent, a relative attitude difference between the aircraft and the surface slope angle, a rate of change of the surface slope angle, aircraft ground sped, a center of gravity, or an aircraft structural limit, among others (and which may be aircraft specific).

The method 200 also includes at 212, providing one or more cues to a pilot. For example, the method 200 may generate a notification when the warning condition is identified (e.g., exceeding a predetermined threshold for a particular characteristic). The notification may include at least one of a tactile feedback, a visual cue, or an aural cue, among others, as described herein. The tactile cue may be at least one of a back drive, a soft stop, or a vibration alert. For example, the aircraft may be a rotary wing aircraft having a vertical axis controller, and the notification may be generated using at least one of a tactile feedback on the vertical axis controller.

Optionally the method 200 includes at 214, taking or performing avoidance measures in response to the warning condition. For example, the avoidance measures may include at least one of an attitude hold or an altitude hold as described herein. Additionally or optionally, the avoidance measure may be to provide at least one of a back drive or a soft stop.

It should be noted that the particular arrangement of components (e.g., the number, types, placement, or the like) of the illustrated embodiments may be modified in various alternate embodiments. In various embodiments, different numbers of a given module, system, or unit may be employed, a different type or types of a given module, system, or unit may be employed, a number of modules, systems, or units (or aspects thereof) may be combined, a given module, system, or unit may be divided into plural modules (or sub-modules), systems (or sub-systems) or units (or sub-units), a given module, system, or unit may be added, or a given module, system or unit may be omitted.

It should be noted that the various embodiments may be implemented in hardware, software or a combination thereof. The various embodiments and/or components, for example, the modules, systems, or components and controllers therein, also may be implemented as part of one or more computers or processors. The computer or processor may include a computing device, an input device, a display unit, and an interface. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer," "controller," "system", and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module", "system", or "computer."

The computer, module, system, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, system, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs, systems, or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from the scope thereof. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, paragraph (f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

What is claimed is:

1. A system comprising:

a surface slope determination system configured to measure a plurality of distances between an aircraft and a surface;

an inertial navigation system configured to sense aircraft attitude information for the aircraft;

a flight control system communicatively coupled to the surface slope determination system and the inertial navigation system, the flight control system configured to estimate a slope angle of the surface based on the plurality of measured distances, wherein the slope angle is defined by at least one of a lateral slope angle formed between an intersection of the surface and a level ground plane in a lateral direction, or a longitudinal slope angle formed between an intersection of the surface and the level ground plane in a longitudinal direction, the flight control system further configured to determine one or more approach characteristics based on the slope angle and the aircraft attitude information, the flight control system additionally configured to identify a warning condition and perform one or more avoidance measures when one or more of the approach characteristics exceeds a predetermined threshold; and a pilot cuing device communicatively coupled to the flight control system, the pilot cuing device configured to generate a notification when the warning condition is identified.

2. The system of claim 1, wherein the notification provided by the pilot cuing device includes at least one of a tactile cue, a visual cue, or an aural cue.

3. The system of claim 1, wherein the aircraft is a rotary wing aircraft having at least one of a vertical axis controller or a translational controller, and the pilot cuing device comprises a tactile feedback device configured to provide a soft stop, a back drive, and a vibration alert on the vertical axis controller or the translational controller.

4. The system of claim 1, wherein the approach characteristic includes at least one of a relative attitude difference between the aircraft and the surface slope angle of the surface.

5. The system of claim 1, wherein the surface comprises a moving surface and the flight control system is further configured to measure a rate of change of the slope angle of the surface of the moving surface.

6. The system of claim 1, wherein the surface slope determination system is configured to measure the plurality of distances based on information received from at least one of an ultrasonic sensor, a RADAR sensor, a laser sensor, or a terrain elevation database.

7. The system of claim 6, wherein at least one of the ultrasonic sensor, the RADAR sensor, or the laser sensor is one of a gimbaled sensor or a fixed sensor.

8. The system of claim 1, wherein the predetermined threshold is based on at least one of a relative attitude difference between the aircraft and the surface slope angle, a rate of change of the surface slope angle, an aircraft ground speed, a center of gravity, or an aircraft structural limit.

9. The system of claim 1, wherein the one or more avoidance measures comprises at least one of an attitude hold or an altitude hold.

10. The system of claim 1, wherein the flight control system is further configured to perform one or more avoidance measures in response to the warning condition, the avoidance measures including a soft stop, a vibration alert, and a back drive.

11. A method comprising:

measuring a plurality of distances between an aircraft and a surface;

sensing aircraft attitude information;

estimating a slope angle associated with the surface based on the plurality of measured distances, wherein estimating the slope angle includes estimating at least one of a lateral slope angle formed between an intersection of the surface and a level ground plane in a lateral direction, or a longitudinal slope angle formed between an intersection of the surface and the level ground plane in the longitudinal direction;

determining one or more approach characteristics based on the slope angle and the aircraft attitude information;

identifying a warning condition when the one or more approach characteristics exceed a predetermined threshold;

generating a notification upon identification of the warning condition; and performing one or more avoidance measures in response to the warning condition.

12. The method of claim 11, wherein generating the notification comprises generating at least one of a tactile cue, a visual cue, or an aural cue.

13. The method of claim 11, wherein the aircraft is a rotary wing aircraft having at least one of a vertical axis controller or a translational controller, and generating the notification comprises using a tactile feedback device providing at least one of soft stop, a back drive, or a vibration alert on the vertical axis controller or the translational controller.

14. The method of claim 11, wherein the approach characteristic includes at least one of a relative attitude difference between the aircraft and the surface slope angle of the surface.

15. The method of claim 11, wherein the surface includes a moving surface and wherein estimating the slope angle of the surface further comprises estimating a rate of change of the slope angle of the moving surface.

16. The method of claim 11, wherein measuring the plurality of distances comprises measuring the plurality of distances based on information received from at least one of an ultrasonic sensor, a RADAR sensor, a laser sensor, or a terrain elevation database.

17. The method of claim 11, wherein the predetermined threshold is based on at least one of a relative attitude difference between the aircraft and the surface slope angle, an aircraft ground speed, a center of gravity, or an aircraft structural limit.

18. The method of claim 11, wherein performing one or more avoidance measures in response to the warning condition comprises performing at least one of an attitude hold or an altitude hold.

19. The method of claim 11, wherein performing one or more avoidance measures in response to the warning condition includes applying at least one of a soft stop, a vibration alert, or a back drive to one or more controllers.

20. An aerial platform comprising:

one of a fixed wing or rotary wing aircraft, the fixed wing or rotary wing aircraft having a warning system, the warning system including, a surface slope determination system configured to measure a plurality of distances between an aircraft and a surface;

an inertial navigation system configured to sense aircraft attitude information for the aircraft;

a flight control system communicatively coupled to the surface slope determination system and the inertial navigation system, the flight control system configured to estimate a slope angle of the surface based on the plurality of distances, wherein the slope angle is defined by at least one of a lateral slope angle formed between an intersection of the surface and a level ground plane in a lateral direction, or a longitudinal slope angle formed between an intersection of the surface and the level ground plane in a longitudinal direction, the flight control system further configured to determine one or more approach characteristics based on the slope angle and the aircraft attitude information, the flight control system additionally configured to identify a warning condition and perform one or more avoidance measures when one or more of the approach characteristics exceeds a predetermined threshold; and a pilot cuing device communicatively coupled to the flight control system, the pilot cuing device configured to generate a notification when the warning condition is identified.

* * * * *